United States Patent [19]

Gutschmit

[11] Patent Number: 4,540,138

[45] Date of Patent: Sep. 10, 1985

[54] TEXTILE YARN CREEL

[75] Inventor: Alan Gutschmit, Troy, N.C.

[73] Assignee: Alandale Knitting Company, Troy, N.C.

[21] Appl. No.: 598,266

[22] Filed: Apr. 9, 1984

[51] Int. Cl.[3] ..... B65H 49/02; D02H 1/00; D03J 5/08

[52] U.S. Cl. ..... 242/131; 66/125 R

[58] Field of Search ..... 242/131, 131.1, 130; 66/125 R, 125 A, 132; 15/300 R, 300 A, 306 A

[56] References Cited

U.S. PATENT DOCUMENTS

| | | | |
|---|---|---|---|
| 2,209,203 | 7/1940 | Kahlisch | 242/131.1 |
| 3,486,309 | 12/1969 | Wild | 15/300 A |
| 3,674,223 | 7/1972 | Philip | 242/131 |
| 3,690,586 | 9/1972 | Bock | 242/131 |
| 3,693,904 | 9/1972 | Bucher | 242/131 |
| 3,915,406 | 10/1975 | Rolli et al. | 242/131 |
| 4,077,084 | 3/1978 | Benson | 15/306 A |
| 4,261,532 | 4/1981 | Davis et al. | 242/131 |

*Primary Examiner*—Leonard D. Christian
*Attorney, Agent, or Firm*—Richards, Shefte & Pinckney

[57] ABSTRACT

A textile yarn creel having a circular supporting framework and plural yarn package supporting members mounted removably and circumferentially slidably thereabout and axially thereof, the supporting members having plural radially inwardly extending pins for mounting of yarn packages thereon for radially inward yarn withdrawal. Guide eyelet members are mounted in a circular arrangement on the circular framework radially inwardly spaced from the package supporting members for receiving the yarns and for direction therefrom to an associated textile machine e.g. a multi-feed circular knitting machine. The package supporting members may be selectively mounted at substantially any locations and spacings circumferentially about the framework for selective expansion and reduction of the creel capacity without changing the floor space occupied. In one embodiment, pivoted arms carry the package supporting pins while in another embodiment the package supporting members are selectively movable radially of the circular framework as well as circumferentially thereabout. The circular nature of the creel and the adjustability thereof give it substantially greater capacity per unit floor space occupied than any known conventional creel. A rotating compressed air blowing arrangement is intermittently operable for removing and preventing lint accumulation on the creel.

35 Claims, 6 Drawing Figures

TEXTILE YARN CREEL

BACKGROUND OF THE INVENTION

The present invention relates to textile yarn creels for supporting a plurality of yarn packages for feeding yarn therefrom to a textile knitting machine or like textile apparatus.

Textile yarn creels of a wide variety of differing constructions and particular uses are widely known and employed throughout the textile industry for storing and supplying yarns to various types of textile machines. Typically, conventional creels basically include an upright, floor-standing, longitudinal framework from which extend plural elements for supporting a plurality of yarn packages for yarn off-winding therefrom. The yarn packages may take the form of cones, tubes, bobbins or the like about which an endless length of yarn is wound. The package supporting elements usually are simple pins or rods arranged in linear horizontal rows and vertical columns outwardly-extending from the upright framework to facilitate the provision of a wall-like bank of the plural yarn packages to be supported.

Most modern yarn-handling or fabric-producing textile machinery are adapted to simultaneously utilize as many as several hundred different yarns. Furthermore, as the United States textile industry struggles to retain or regain its competitiveness with low cost foreign manufactured goods, much effort has been devoted to improving the efficiency of floor space utilization in manufacturing operations. As a result, the trend in recent years in textile machinery design has been toward reducing the overall dimensions of machines and/or increasing the yarn usage capabilities of machines, so as to improve production per unit space. As just one example, state-of-the-art circular knitting machines are presently available of substantially the same overall dimensions as comparable circular knitting machines manufactured and sold 15–20 years ago, but are capable of feeding and knitting with up to or more than twice as many yarns as such older machines.

While such improvements in manufacturing machinery provide improved production efficiency, new problems result which can negate any cost savings realized. First, the greater capability of conventional machines for yarn usage creates a requirement for correspondingly increased space usage for yarn supply and storage, e.g. yarn creels. Conventional creels of the above-described general type are constructed to a fixed size and fixed package storage capacity. Accordingly, as yarn requirements increase, additional creel units requiring additional floor space must be utilized, and, conversely, if any creel is utilized at less than its full capacity, wasted space results. Such yarn storage problems are compounded by the fact that most conventional creels provide for the storage of yarn packages in pairs, one package to be initially used for yarn feeding and the other package to be stored in tandem with the first package for replacement thereof when the yarn of the first package is fully spent.

Increased yarn usage and fabric production per unit space additionally creates a corresponding increase in the production of lint and similar fibrous debris and waste. As is recognized by persons skilled in the art, lint accumulation on machinery can restrict or entirely prevent proper operation of machine mechanisms, cause machine shut-down and produce defective goods, as well as numerous other problems. Additionally, airborne lint poses a significant health hazard to works. Accordingly, there exists the increased necessity with the use of more efficient conventional textile machinery for periodic cleaning of the machinery, the floor space it occupies, and the surrounding air in order to minimize lint accumulation.

In contrast, the present invention provides a textile yarn creel of a compact circular construction uniquely and particularly adapted for permitting the selected increase or decrease of the package storage capacity of the creel without increasing the overall floor space it occupies. Additionally, the creel includes a special arrangement for preventing lint accumulation.

SUMMARY OF THE INVENTION

Briefly described, the textile yarn creel of the present invention includes a circular frame and a plurality of longitudinal yarn package supporting arrangements adapted to be mounted axially on the frame at selected circumferential locations and spacings thereabout. Each of the yarn package supporting arrangements has a plurality of package mounting elements spaced therealong for facing radially inwardly of the frame when the supporting members are mounted thereon. In use, a selected number of the yarn package supporting arrangements are mounted on the frame at selected locations and spacings circumferentially thereabout for supporting a selected number of yarn packages for feeding yarns therefrom. A yarn guiding arrangement is disposed axially centrally of the frame for receiving the yarns withdrawn from the yarn packages in a direction radially inwardly of the frame and for directing the yarns to an associated textile apparatus, e.g. a circular knitting machine. In this manner, the creel is adapted for selective use of any selected number of the yarn package supporting arrangements to permit the supporting of differing pluralities of yarn packages in the same compact circular area defined by the circular frame.

According to another feature of the present invention, a special assembly for removing lint from the creel is provided which basically includes a compressed air source and an air emission tube disposed substantially axially centrally of the frame and connected with the compressed air source to receive compressed air therefrom. A plurality of emission ports are formed in the emission tube at selected locations spaced therealong for emitting compressed air radially outwardly toward the frame, the yarn package supporting arrangements and the yarn guiding arrangement. A motor or like mechanism is provided for rotating the emission tube. A timing arrangement is provided to periodically actuate the motor to rotate the emission tube at least one complete revolution and to simultaneously actuate the compressed air source to direct the compressed air into the emission tube for emission outwardly through the emission ports about the full circumference of the creel during such tube rotation for removing and preventing lint accumulation thereon. As an alternative lint removal assembly, a fan may be mounted on the frame to move ambient air thereacross to remove and prevent lint accumulation.

In the preferred embodiment, the frame is constructed of two circular frame members each including inner and outer concentric circular elements. Each yarn package supporting arrangement includes two identical sets of plural package support pins spaced transversely of the length of the supporting member with the pins of the two sets spaced correspondingly along the supporting arrangement and extending outwardly therefrom so as to extend generally radially inwardly of the frame when mounted thereon. In conventional manner, the two sets of pins are respectively adapted for supporting a first set of yarn packages for yarn feeding use and a second set of yarn packages for replacement of the first set of packages upon exhaustion thereof.

In one embodiment of the yarn package supporting arrangements, each arrangement includes a longitudinal member having two sets of plural package support arms mounted respectively along opposite sides the longitudinal member. Each package support arm has one of the package support pins extending therefrom and is pivotal between an operative position wherein the pin is disposed at an outward spacing from its respective side of the longitudinal member so as to extend radially inwardly of the frame when the longitudinal member is mounted thereon to orient a yarn package supported by the pin to extend toward the yarn guiding arrangement for yarn withdrawal and an inoperative position wherein the arm and the pin are spaced from the operative position sufficiently for withdrawal of a spent yarn package and insertion of another yarn package through the space occupied by the arm and the pin in the operative position.

In another embodiment of the yarn package supporting arrangements, each arrangement includes a pair of longitudinal members for independent mounting on the frame in side-by-side relation at selected circumferential spacings from one another, each of the longitudinal members including one set of the package support pins.

The yarn package supporting arrangements are preferably mounted on the outer circular elements of the frame members by a slot arrangement at each end of each yarn package supporting arrangement for receiving the outer circular elements so as to permit selective sliding movement circumferentially thereon of the yarn package supporting arrangements. A selectively-actuable clamping device is provided with each slot arrangement for receipt therein for braced engagement with the slot arrangement and the frame members for holding them together. In one embodiment of the slot arrangement, slots are formed in each end of the above-described longitudinal members for receiving the outer circular elements and the clamping devices. In another embodiment of the slot arrangement, brackets are provided for each end of each yarn package supporting arrangement, each bracket having the slot arrangement for receiving the outer circular elements and also having a channel arrangement extending perpendicularly of the slot arrangement for receiving the associated yarn package supporting arrangement for movement in the channel arrangement radially relative to the frame.

The yarn guiding arrangement preferably includes a plurality of longitudinal yarn eyelet members corresponding in number to the plurality of yarn package supporting arrangements and adapted to be mounted axially on the inner circular frame elements at selected circumferential locations and spacings thereabout. Each of the yarn eyelet members has a set of yarn eyelets spaced therealong corresponding in number and spacing to one of the sets of package support pins for facing generally radially outwardly of the inner circular elements when mounted thereon. In use of the creel, the same number of yarn eyelet members as the selected number of yarn package supporting arrangements are mounted on the inner circular elements at selected circumferential locations and spacings to be respectively positioned circumferentially intermediate the two sets of the package support pins of each yarn package supporting arrangement. In this manner, yarn will travel along radially inward paths between the yarn package supporting arrangements and eyelet arrangements in substantially identical fashion from both the primary and replacement packages supported on the two sets of pins. The yarn guiding arrangement also includes a plurality of yarn feeding tubes for connection respectively with the yarn eyelets of the eyelet members for receiving the yarns from the eyelets and directing the yarns to the associated textile apparatus.

DESCRIPTION OF THE PREFERRED EMBODIMENT

Figure 1:
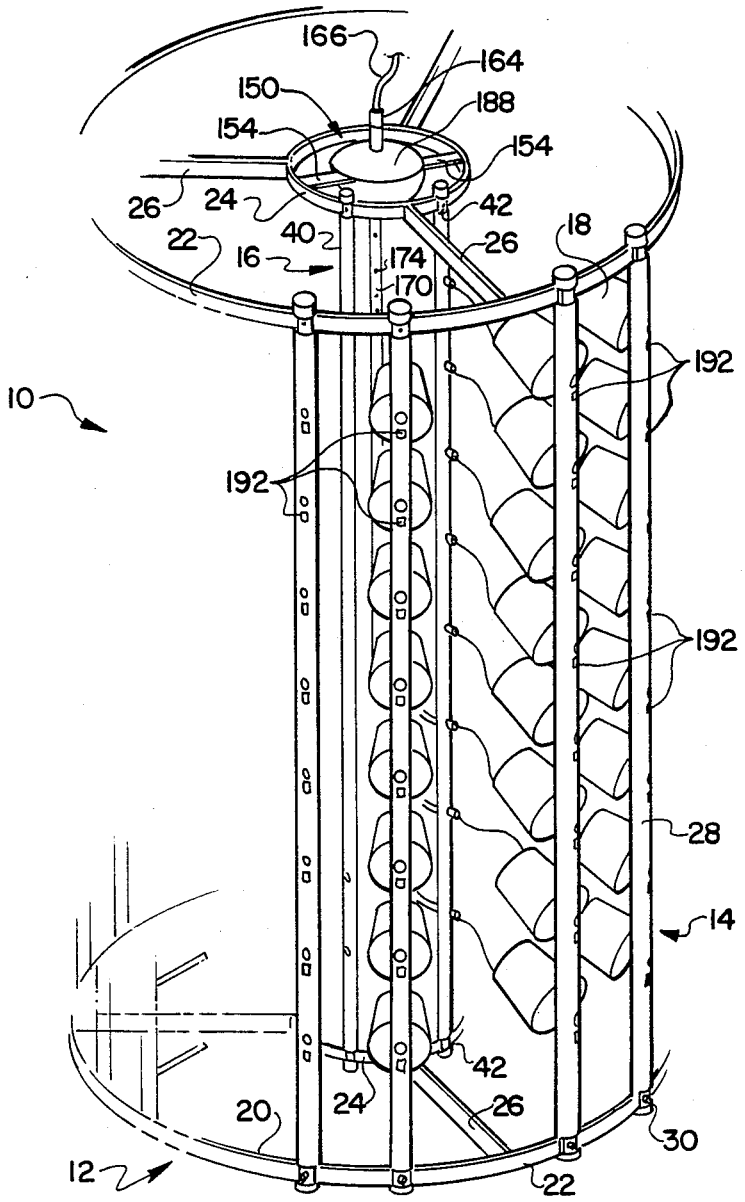
FIG. 1 is a perspective view of a textile yarn creel according to one embodiment of the present invention.
Figure 2:
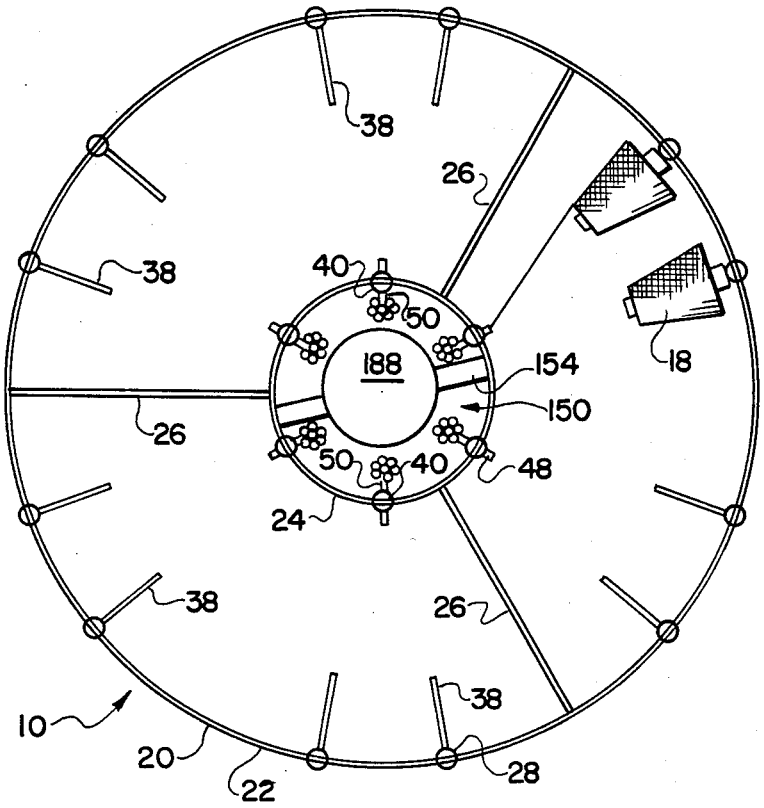
FIG. 2 is a top plan view of the creel of FIG. 1.
Figure 3:
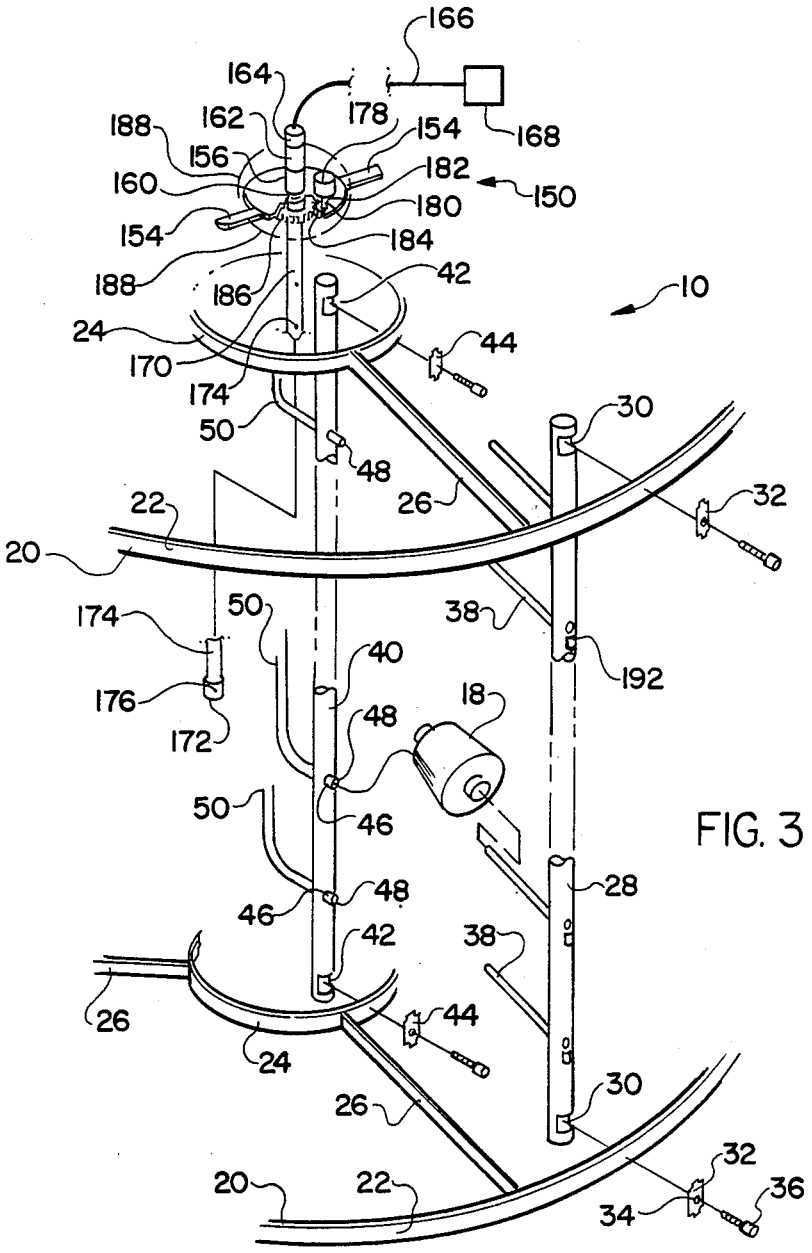
FIG. 3 is a partial exploded perspective view of the creel of FIG. 1.

Referring now to the accompanying drawings and initially to FIGS. 1–3, one embodiment of a textile yarn creel according to the present invention is generally indicated at 10. For illustrative purposes, the creel 10 is shown as being set up for use in supplying yarn to a circular knitting machine (not shown) having 48 feeds and thereby requiring 48 separate yarn supplies. As is more fully explained hereinafter, the creel 10 is adapted to hold 48 pairs of yarn packages for initial use and replacement use. In normal use, the creel 10 would be positioned upstanding on the floor of the knitting room directly beside the associated circular knitting machine.

Basically, the creel 10 includes a circular mounting framework, generally indicated at 12, a plurality of longitudinal yarn package supporting members, generally indicated at 14, mounted in a circular arrangement about the framework to extend axially thereof in parallel relation with one another, and a plurality of yarn guide eyelet members, generally indicated at 16, mounted in an axially parallel circular arrangement about the framework 12 radially inwardly of and concentric with the package support members 14. As more fully explained hereinafter, the package support members 14 support the aforementioned plurality of yarn packages 18 radially inwardly of the framework 12 for radially inward yarn off-winding therefrom. The guide eyelet members 16 receive the yarns from the packages 18 and the yarns are directed therefrom upwardly through the central axial area of the creel 10 and then overhead to be fed to the knitting machine.

The creel 10 of the present invention is primarily designed and adapted for use in supporting and feeding spun yarns, i.e. yarns formed by twisting of staple length fibers, which are wound circumferentially about a conical support member for yarn off-winding from the smaller end of the cone in an axial direction. However, those persons skilled in the art will readily recognize the adaptability of the present creel for use in supporting and feeding virtually any type of yarn wound about any of a wide variety of supporting members or elements. Accordingly, the present invention is not to be limited to use with spun yarns nor use with cone-supported yarn packages. As used herein, the term "yarn" therefore is intended to include any type of spun or filamentary textile yarn, whether of synthetic or natural fiber, as well as any other strand material. Also as used herein, the term "yarn packages" means nay assemblage of yarn on any sort of support member including a cone, tube, bobbin, or the like.

The circular mounting framework 12 includes a pair of identical circular frame members 20 each of which has an outer and inner circular elements 22,24, respectively, rigidly affixed concentrically together by three linear struts 26 extending radially therebetween at equal circumferential spacings. The inner and outer circular elements 22,24 are formed of selected lengths of flat metal bar stock formed into a circular configuration of desired diameters and weld together at their ends. The struts 26 are formed from the same metal bar stock and welded in the described relationship to the inner and outer elements 22,24.

As best seen in FIG. 3, each yarn package supporting member 14 is formed from a length of linear round metal tubing 28. The ends of the tube 28 have slots 30 formed transversely, i.e. circumferentially, therein at one circumferential side thereof. The slots 30 are of an axial length slightly greater than the width of the bar stock from which the circular frame members 20 are constructed so as to be adapted to receive the outer elements 22 in the slots 30. In this manner, the tube 28 of each yarn package supporting member 14 is adapted for selective mounting on and removal from the outer elements 22 of the circular frame members 20 and also for selective slidable circumferential positioning movement thereabout. A clamping element 32 is provided for each slot 30 and basically includes a plate of a slender width relative to the diameter of the tube 28 and of a slightly greater length than the axial dimension of each slot 30. Each clamping element 32 is thus adapted to be manipulated for insertion in its associated slot 30 for receipt therein in an orientation extending lengthwise axially of the respective tube 28 for disposition intermediate the outer element 22 received in the slot 30 and the inner surface of the tube 28 at the side thereof in which the slot 30 is formed. A tapped opening 34 through the lengthwise center of each clamping element 32 threadedly receives an associated screw 36 which is selectively movable threadedly into engagement with the outer element 22 to urge it fully into the slot 30 and to urge the longitudinal ends of the clamping element 32 into engagement with the inner surface of the tube 28 longitudinally adjacent the slot 30 to brace and hold the outer circular element 22 and the tube 28 rigidly together.

It will be understood that the slots 30 permit the mounting of the yarn package supporting members 14 on the outer circular elements 22 of the frame members 20 with the slotted side of each supporting member 14 facing either radially inwardly or radially outwardly of the frame members 20. Preferably, the supporting members 14 are to be mounted with the slots 30 facing radially outwardly to permit easier access to and operation of the clamping elements 32.

A plurality of package mounting pins 38 are fixed to each tube 26 by welding or other manner of affixation so as to extend generally radially from the side of the tube 28 opposite the slots 30. Additionally, the pins 38 of each tube 28 are inclined slightly toward one end thereof to be disposed upwardly when mounted on the frame members 20. Therefore, the pins 38 will extend radially inwardly and slightly upwardly of the frame members 20 for receiving and supporting the yarn packages 18. Preferably, eight pins 38 are provided on each tube 28 since the number of feeds of many conventional circular knitting machines are multiples of eight.

Each yarn guide eyelet member 16 is of comparable construction to the yarn package supporting members 14, as will also be best seen in FIG. 3. Each yarn guide eyelet member 16 is formed from a corresponding length of linear round steel tubing 40 having slots 42 formed in each end thereof and clamping elements 44 provided in association with each slot 42 to permit removable and circumferentially slidable mounting of each tube 40 on the inner circular elements 24 of the frame members 20 in the same manner as described above with respect to the yarn package supporting members 14. As with the tubes 28 of the yarn package supporting members 14, the tubes 40 of the yarn guide eyelet members 16 are preferably mounted on the inner circular elements 24 with the slots 42 facing radially outwardly for ready access thereto. Each tube 40 has a plurality of holes 46, preferably of the same number as the number of pins 38 provided on each tube 28 of the yarn package supporting members 14, formed diametrically through the tube 40 and circumferentially centered relative to the circumferential extent of the slots 42 of the tube 40. A porcelain or plastic yarn guide eyelet is fitted in each hole 46 at the slotted side of the respective tube 40 so as to face radially outwardly of the inner circular elements 24 when mounted thereon. A flexible plastic tube 50 is fitted in each hole 46 at the opposite, radially-inward side of the respective tube 40 and is of a length sufficient to extend therefrom upwardly through the axially central area of the creel framework 12 and overhead to the adjacent knitting machine.

It is preferred that three or more support foot members 45 to be mounted on the bottom frame member 30 at spacings thereabout to support the framework 12, the yarn package supporting member 14 and the yarn guide eyelet members 16 at a slight elevation above the floor on which the creel 10 is positioned. Each foot member 45 is formed of a short length of round tubing 47 having a slot 49 formed therein and an associated clamping device 51 for mounting of the tubing 47 on and affixation thereof to the outer circular element 22 of the bottom frame member 20. In this manner, the elevation of the yarn package supporting member 14 and the yarn guide eyelet members 46 facilitate easy sliding positioning movement of them circumferentially about the frame members 20 without interference with the floor.

The creel 10, by virtue of its capability for selective removal and circumferential positioning of its yarn package supporting members 14 and its yarn guide eyelet members 16, permits adjustable set up of the creel 10 for supporting and feeding widely varying numbers of yarn packages 18 of varying sizes and for a variety of different applications. For example, in the illustrated application, the creel 10 of FIGS. 1–3 is set up for use in feeding forty-eight yarns to a forty-eight feed circular knitting machine, as previously mentioned. In accordance with conventional practice, the present creel 10 is adapted to support ninety-six yarns packages 18 in forty-eight pairs, one package of each pair being utilized for feeding use and the other package being provided for replacement of the first package when spent. Accordingly, in the set up of the creel 10, twelve yarn package supporting members 14 each having eight pins 38 would be mounted on the outer elements 22 of the circular frame members 20 in six pairs spaced circumferentially about the creel 10. Preferably, the yarn package supporting members 14 of each pair are mounted closer to one another than to the adjacent yarn package supporting members 14 of other pairs so as to permit sufficient space between each pair of yarn package supporting members 14 for periodic removal of the empty cones of spent packages and the insertion of new full packages. Thus, as shown in FIG. 2, one manner of arranging the creel 10 for forty-eight feeds is to locate paired yarn package supporting members 14 twenty degrees apart and adjacent yarn package supporting members 14 of different pairs forty degrees apart. Six yarn guide eyelet members 16 each having eight eyelets 48 would be mounted at selected locations and spacings circumferentially about the inner circular elements 24 to be each circumferentially centered between a respective pair of yarn package supporting members 14, e.g., spaced sixty degrees apart as seen in FIG. 2. In this manner, yarns off-wound from the yarn packages 18 travel in radially inward paths to the eyelets 48 in substantially identical fashion from yarn packages mounted on either yarn package supporting member 14 of each pair thereof. The yarns travel from the eyelets 48 into the associated plastic tubes 50 and therefrom to the respective feed locations of the circular knitting machine.

It will be understood that the creel 10 is equally adaptable for use in either expanded or reduced capacities by the selective addition, removal and circumferential repositioning of the yarn package supporting members 14 and the yarn guide eyelet members 16. The factor primarily limiting the maximum capacity of the creel 10 is the need for maintaining sufficient space between adjacent yarn package supporting members 14 of different pairs thereof to permit insertion of new full yarn packages in replacement of spent packages. Notably, the spacing between the yarn package supporting members 14 of a pair may be varied and, particularly, may be reduced from the spacing necessary to accommodate simultaneous support on both supporting members 14 of completely full yarn packages. It is conventional wisdom that it is preferable to delay the mounting of a replacement package on a creel for as long as possible while the associated package in feeding use is being exhausted, thereby to reduce the time over which the replacement package is exposed to the accumulation of lint and debris thereon while resting unused on the creel. Thus, by virtue of the selective movability of the yarn package supporting members 14 on the creel 10, the spacing between paired yarn package supporting members 14 may be reduced considerably, limited only by the size of one full yarn package and the size to which a yarn package in use can be permitted to be exhausted without comprising or inhibiting the physical ability of the knitting machine attendant to mount all necessary replacement yarn packages before the packages in use become fully spent.

Thus, the creel 10 provides several significant advantages over conventional creels. First, the creel 10 facilitates considerably more economical use of available floor space in the knitting room thereby permitting greater production capacity per unit floor area and reduction of overhead costs. By the circular nature of the creel 10, it is considerably more compact than conventional linear bank-type creels of the type above-described. Furthermore, the adjustability of the creel 10 permits the accommodation of different numbers of yarn packages for support and feeding as well as permitting the accommodation of different package sizes without increasing the floor space of the knitting room occupied by the creel 10. Contrastingly, conventional creels which are not adjustable are designed to hold a fixed number of packages and, if greater package support capacity is required, an additional creel or creel unit must be utilized, necessarily requiring additional floor space. Additionally, conventional creels are typically constructed to accommodate the maximum conventional size yarn package. Therefore, if smaller yarn packages are utilized, the lack of adjustability of the conventional creels results in wasted space. Conversely, if larger than conventional yarn packages are to be utilized, conventional creels cannot accommodate them. In addition, the radial orientation of the support pins provided by the circular nature of the creel 10 in conjunction with the conical nature of conventional cone-mounted yarn packages, result in the sides of adjacently-supported pairs of yarn packages being oriented more parallel to one another than with conventional creels, whereby the yarn packages may be mounted more closely together. As an ultimate result, the creel 10 provides considerably greater yarn storage and feeding capacity per unit floor space occupied than any known conventional creel of any type construction. It is contemplated that frame members 20 for the creel 10 may be constructed of two or perhaps three different diametric sizes to facilitate substantially the full range of package support capacities which could be conventionally required.

The present creel 10 can additionally contribute significantly to the reduction of overall labor costs and the improvement of the overall quality of the knitted fabric produced by the knitting operation. The greater compactness of the creel 10 also reduces the floor area required to be covered by the knitting machine attendant in maintaining the creel 10 properly stocked and replenished with replacement yarn packages. Therefore, the attendant is better able to be responsible for a greater number of yarn packages and perhaps a greater number of creels and knitting machines. In this regard, the adaptability of the creel 10 to different package sizes permits use of packages which are considerably larger in size than those conventionally used and therefore less often replacement would be required in such instances, further enabling the attendant to undertake increased responsibilities. Additionally, the aforementioned facility of the creel 10 for permitting the selective locating of the paired yarn package supporting members sufficiently closely together that the attendant must necessarily permit the yarn packages in use to run down before mounting a replacement package eliminates the conventional need to train knitting machine attendants to do so and to monitor their adherence to this conventional procedure. In conjunction with the facility for closer disposition of paired packages together, the circular nature of the creel 10 permits the provision of a greater than conventional distance between the supported yarn packages and the guide eyelets so that a straighter, more linear yarn path therebetween is provided to reduce the creation of frictional forces on the yarn and to minimize the degree and occurrence of tension variations in the yarn which are known problems resulting in conventional creels which are constructed to dispose the yarn packages relatively more closely to and at relatively greater angular displacements from the withdrawal eyelets in order to save space.

Figure 4:
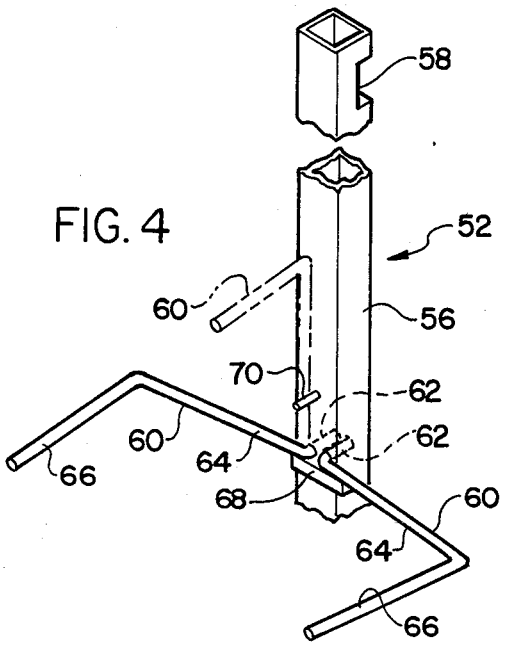
FIG. 4 is a partial perspective view of another embodiment of yarn package supporting member for use with the creel of FIG. 1.
Figure 5:
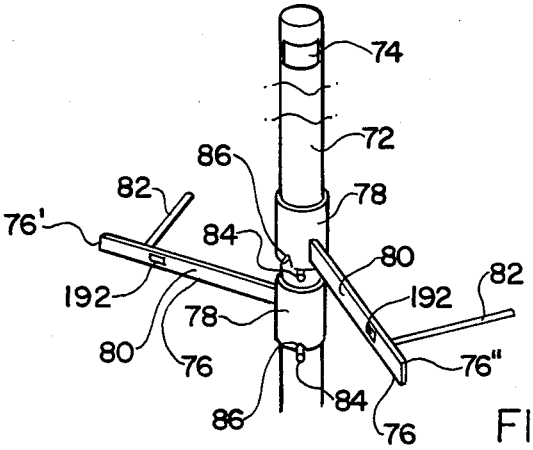
FIG. 5 is a partial perspective view of another embodiment of yarn package supporting member for use with the creel of FIG. 1.

FIGS. 4 and 5 show modified forms of yarn package supporting members, respectively indicated therein generally at 52 and 54, which may be used in the creel 10 instead of the yarn package supporting members 14 of FIGS. 1–3. Referring first to FIG. 4, the yarn package supporting member 52 is formed from a length of linear square metal tubing 56 having slots 58 formed at its ends at one side of the tube 56 to facilitate mounting on the outer circular elements 22 by the use of clamping elements 32 in the same manner as above-described with respect to the tubes 28 of the yarn package supporting members 14. A plurality of yarn package support arms 60 are mounted in side-by-side pairs at spacings along the side of the square tube 56 opposite its slotted side for disposition of the arms 60 on the radially inward side of the outer circular elements 22 when the tube 56 is mounted thereon. Each package support arm 60 is formed of a round steel rod bent to a generally Z-shape with a relatively short mounting leg 62, an intermediate portion 64 oriented angularly to the mounting leg 62, and a main leg 66 extending angularly from the intermediate portion 64 in generally the opposite direction from the mounting leg 62. The mounting leg 62 of each arm 60 extends rotatably through the square tube 56 substantially perpendicularly to the longitudinal axis of the tube 56 for pivotal movement of the arm 60 about the mounting leg 62. A support shoulder 68 is welded to the tube 56 immediately beneath the mounted location of the mounting legs 62 of each pair of arms 60 to provide an abutment to the intermediate portions 64 of the arms 60 to support them in an operative disposition shown by the arms 60 in full lines in FIG. 4 wherein the intermediate portions 64 extend transversely outwardly from the tube 56 in opposite directions to dispose the main legs 66 for generally radially inward orientation to the outer circular elements 22 of the frame members 20 when the tube 56 is mounted thereon. Preferably, the intermediate portion 64 of each arm 60 is formed at a slightly greater than 90 degree angle to the mounting leg 62, e.g. 98 degrees to 99 degrees, and the main leg is oriented approximately perpendicularly to the intermediate portion 64 and is bent slightly upwardly from the common plane of the mounting leg 62 and the intermediate portion 64, whereby the main leg 66 will be radial relative to the framework 12 and will be slightly upwardly inclined in its operative position. A small pin 70 extends outwardly from the tube 56 immediately above each pair of arms 60 to provide a stop for movement of each arm 60 to an inoperative position wherein the intermediate portion 64 is abutted against the pin 70, as indicated by the arm 60 in broken lines in FIG. 4.

Referring now to FIG. 5, the yarn package supporting member 54 is formed from a length of linear round metal tubing 72 having slots 74 formed at its ends in the same manner as the tube 28 of the yarn package supporting member 14. A plurality of arm members 76 are mounted along the tube 72 in stacked pairs. Each arm member 76 includes a mounting sleeve 78 slidably disposed about the tube 72 and an arm 80 extending radially outwardly from the sleeve. The arms 80 of each pair of arm members 76 have package support pins 82 extending perpendicularly from opposite sides of the arms 80. A plurality of screws 84 are threadedly fixed in the slotted side of the tube 72 at spacings therealong for supporting abutment of the sleeves 78 of the arm members 76 in the aforementioned stacked pairs at predetermined spacings. Each sleeve 78 has a notch 86 formed in the lower edge thereof at a spacing of approximately slightly greater than 90 degrees, preferably 98–99 degrees, from its arm 80 in the circumferential direction away from its pin 82 for receiving the associated screw 84 in the notch 86 to orient the arm member 76 in an operative disposition in which the pin 82 of the arm member 76 is oriented to extend radially inwardly of the outer circular elements 22 of the frame members 20, as indicated by the arm member 76' in FIG. 5. Each pin 82 is preferably inclined slightly upwardly from its arm 80. Each arm member 76 may be selectively slided longitudinally of the tube 72 to disengage the notch 86 from the screw 84 and then pivoted rotatably about the tube 72, as indicated by the arm member 76'' in FIG. 5, to permit selective pivotal movement of each arm member 76 to an inoperative position wherein the arm 80 extends radially outwardly of the frame members 20.

Each yarn package supporting member 52,54 therefore performs the function of two of the above-described yarn package supporting members 14. Pivotal movement of the arm members 60,76 of each embodiment facilities removal of spent yarn packages and insertion of new full yarn packages in the following manner. When a yarn package is fully spent, the operator first reaches either above or below the arm member 60 or 76 on which the package is mounted and removes the cone or other package supporting member from the main leg 66 or the pin 82 without moving the supporting arm member 60 or 76 from its operative position. While holding the removed spent package radially inwardly of the framework 12, the operator then pivots the arm member 60 or 76 to its inoperative position, withdraws the spent yarn package supporting member through the space previously occupied by the arm member 60 or 76, inserts a new full yarn package through such space and, while holding the new yarn package, the operator pivots the arm member 60 or 76 to return it to its operative position and then places the new package on the main leg 66 or the pin 82. As will thus be understood, the arm members 60 and 76 of the yarn package supporting members 52,54 eliminate the need to leave space between adjacent package supporting members for removal of spent yarn packages and insertion of new full yarn packages. It is therefore possible to arrange the yarn package supporting members 52,54 about the outer circular elements 22 of the frame members 20 much more closely together, limited only by the size of the yarn packages being used and the need to prevent adjacent packages from touching one another. Much greater space savings are therefore realizable in utilizing the yarn package supporting members 52,54 than even with the yarn package supporting members 14, thereby even further promoting the advantages of the supporting members 14 above-discussed. By way of example, a creel constructed according to the present invention to a diameter of the outer circular elements 22 of the frame members 20 or 84 inches is capable of providing support for up to 224 conical yarn packages of a $10\frac{1}{4}$ inch maximum outer diameter by utilizing 14 of the yarn package supporting members 52 or 54 each having 16 total arm members 60 or 76 arranged as described in eight pairs thereof.

Figure 6:
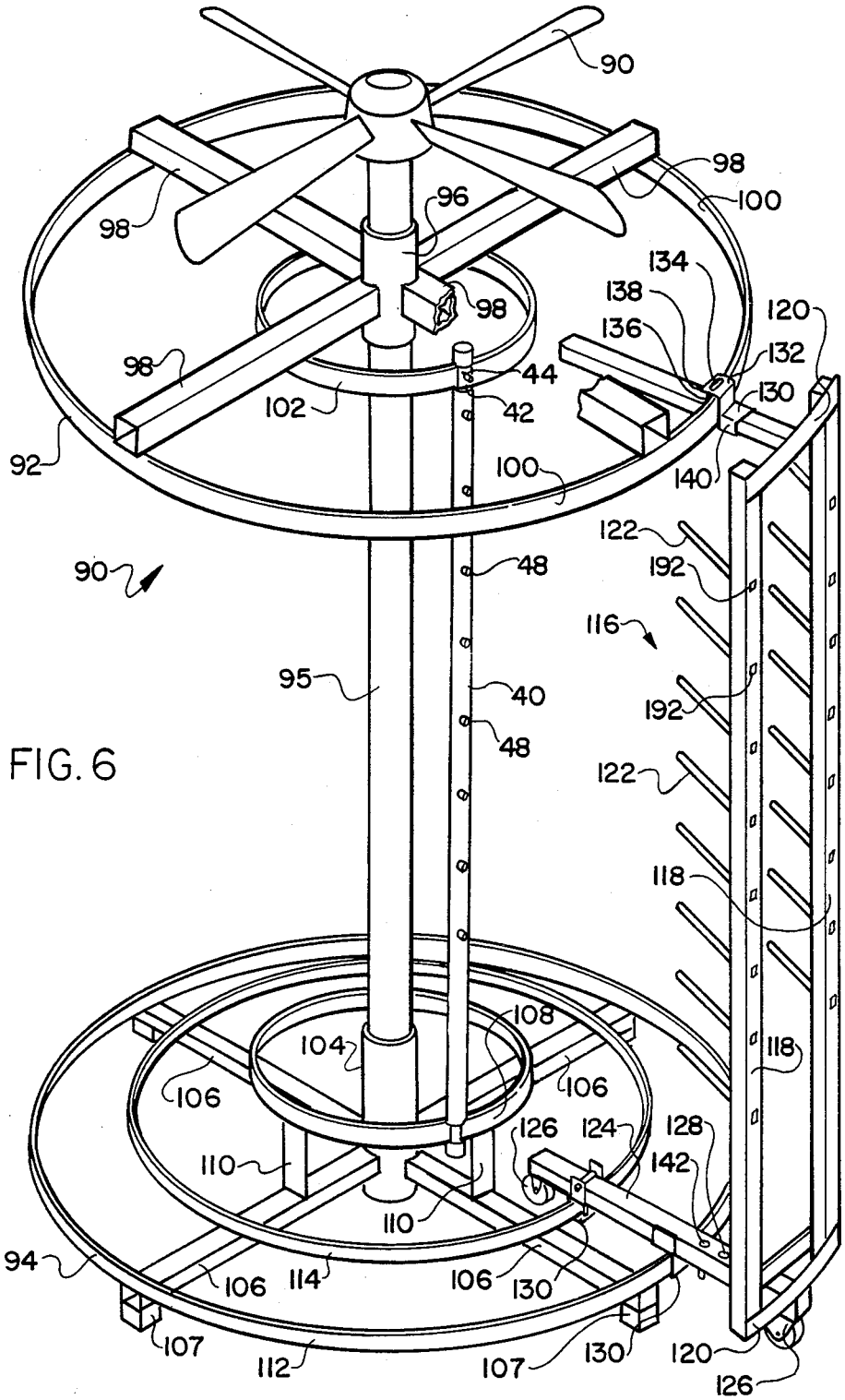
FIG. 6 is a perspective view of another embodiment of textile yarn creel according to the present invention.

FIG. 6 illustrates a further embodiment of a creel according to the present invention, indicated therein generally at 90. The creel 90 utilizes slightly modified circular frame members 90,92. The frame member 92 is adapted for use as the top frame member and has a central cylindrical sleeve 96 to which four square tubular support members 98 extend radially outwardly at 90 degree spacings, inner and outer circular elements 100,102 being affixed to the support members 98 concentrically with each other and with the sleeve 96. The frame member 94 is adapted for use as the bottom frame member and is of a similar construction to the frame member 92. The frame member 94 includes a central cylindrical sleeve 104 to which four square tubular support members 106 are affixed to extend radially outwardly at 90 degree spacings. A short piece 107 of the same square tubing is affixed to the lower side of each tubular support member 106 at the outer end thereof to provide support feet for resting the frame member 94 on the floor on which the creel 90 is to be positioned. An inner circular frame element 108 of the same diameter as the inner circular element 102 of the frame member 92 is affixed to the support members 106 at an elevation thereabove by four support bars 110 extending therefrom axially with respect to the sleeve 104 to support the inner circular element 108 concentrically with the sleeve 104. An outer circular element 112 is affixed directly to the outer ends of the support members 106 concentrically with the sleeve 104 and an intermediate circular element 114 is affixed directly to the support members 106 between the inner and outer circular elements 108,112 concentrically therewith and with the sleeve 104. The frame members 92,94 are supported coaxially in parallel spaced relation on a vertical support tube 95 which extends respectively through the sleeves 96,104.

The creel 90 utilizes a plurality of yarn package supporting members, one of which is generally indicated in FIG. 6 at 116. Each yarn package supporting member 116 includes two lengths of linear square metal tubing 118 affixed side-by-side in parallel relation by arcuate cross bars 120 affixed to and extending generally perpendicularly between the respective ends of the tubes 118. A plurality, preferably eight, of package supporting pins 122 are fixed to and extend from the side of each tube 118 facing away from the arcuate cross bars 120 at corresponding spacings along the tubes 118. The pins 122 are preferably inclined slightly toward one end of the yarn package supporting member 116 which end will be disposed upwardmost when mounted on the frame members 92,94. Each arcuate cross bar 120 has another linear square tube 124 affixed at one of its ends to the cross bar 120 midway between the two tubes 118 and extending radially inwardly from the cross bar 120. The tube 124 at the lower end of the yarn package supporting member 116 is provided with casters 126 mounted at each end of the tube 124 on the lower side thereof. A plurality of holes 128 are formd along the length of the caster-mounted tube 124 at the end thereof affixed to the arcuate cross bar 120.

To facilitate connection of each yarn package supporting member 116 with the frame members 92,94, three bracket members 130 are provided for respective mounting on the outer and intermediate circular elements 112,114 of the bottom frame member 94 and on the outer circular element 100 of the top frame member 92. Each bracket member 130 includes a C-shaped slot member 132 adapted to receive the associated circular frame element 100,112,114 so as to be mountable thereon, the C-shaped slot member 132 having openings 134 adjacent each free end thereof to receive a clamping element 136 to extend across the free ends of the slot member 132 for enclosing it about the associated circular frame element 100,112,114. A screw 138 tapped in each clamping element 136 permits tightened bracing affixation of the C-shaped slot member 132 to the associated circular frame element 100,112,114. A U-shaped channel member 140 is welded to one free side of the slot member 132 and is adapted to receive slidably therein an associated square tube 124.

A plurality of the yarn guide eyelet members 16 above-described are utilized in the creel 90 for selective mounting on the inner circular elements 102,108 of the frame members 92,94 to extend axially therebetween.

In use of the creel 90, each yarn package supporting member 116 is adapted to support both a plurality of yarn packages 18 for initial feeding use and a plurality of yarn packages 18 for replacement use respectively on the pins 122 of the two tubes 118. For each yarn package supporting member 116 to be employed in any given application, two bracket members 130 are mounted on the outer and intermediate circular elements 112,114 of the bottom frame member 94 and one bracket member 130 is mounted on the outer frame element 100 of the top frame member 92 at selected locations and spacings circumferentially about the frame members 92,94. Each yarn package supporting member 116 is oriented with its tubes 124 extending radially inwardly with respect to the frame members 92,94 and slidably disposed in the U-shaped channel members 140 of the associated bracket members 130 with the casters 126 respectively disposed radially inwardly and outwardly of the intermediate circular element 114 and the outer circular element 112 of the bottom frame member 94. As will thus be understood, each yarn package supporting member 116 is slidably and rollably adapted for selective radially inward and outward movement relative to the supporting frame members 92,94, the intermediate circular element 114 of the bottom frame member 94 acting as a stop to the radially outward movement of the inward caster 126 to restrict the outward movement of each supporting member 116 and the outer circular element 112 of the bottom frame member 94 acting as a stop either to the outward caster 126 or to a pin 142 selectively positioned in one of the plural holes 128 in the bottom tube 124 to restrict the radially inward movement of the supporting member 116. Normally, the creel 90 will be operated with the yarn package supporting members 116 at their radially inwardmost positions as defined by the placement of the pin 142 or of the outer caster 126.

As will be recognized, the bracket members 130 facilitate selective circumferential movability of the yarn package supporting members 116 on the frame members 92,94 and thereby the creel 90 provides the same advantages as discussed above with respect to the embodiment of the creel 10. Additionally, the selective movability of the yarn package supporting members 116 radially of the frame members 92,94 provides several additional advantages. As with the embodiments with the yarn package supporting members 52,54 of FIGS. 4 and 5, additional space savings are realized in that it is not necessary in the creel 90 to provide space between the adjacent yarn package supporting members 116 for insertion of new packages and removal of spent packages. Instead, the attendant can independently roll each yarn package supporting member 116 radially outwardly of the frame members 92,94 without interrupting the creel operation so as to permit removal of spent packages and placement of new full packages on the supporting members 116. Additionally, the selective placement of the pins 142 in the holes 128 of the tubes 124 enables the effective outer overall diameter of the creel 90 to be selectively varied. As the yarn package supporting members 116 are utilized in more radially outward dispositions relative to the frame members 92,94, a greater number of the supporting members 116 may be utilized thereby to increase the overall capacity of the creel. Accordingly, with the creel 90, it is not necessary, or at least it is less necessary, to construct and have available circular creels of the present invention of different diametric sizes to adapt to different applications and package support capacities.

The present invention also provides a novel arrangement generally indicated at 150 in FIGS. 1–3 for removing and preventing accumulation of lint, stray fibers and like debris on creels according to the present invention. The lint removal arrangement 150 is mounted on a circular plate 152 affixed centrally of the inner circular element 24 of the top frame member 20 by two connecting bars 154 extending inwardly from the inner circular element 24. A conventional solenoid-actuated air valve, indicated schematically at 156, is mounted on the top of the plate 152 at the axis thereof and the mounting hub of a conventional rotatable air valve, indicated schematically at 158, is affixed to the bottom of the plate 152 at the axis thereof, the solenoid and rotatable valves 156,158 communicating with one another through a central opening 160 in the plate 152. The solenoid valve 156 is connected by a length of round tubing 162 with a "quick-connect" tubular coupling 164 which is connected by a flexible hose 166 with a remote source of compressed air, schematically indicted at 168. One end of a hollow round tube 170 is affixed coaxially to the depending rotatable hub of the rotatable air valve 158 so as to be rotatable therewith. A cap 172 encloses the tube 170 at its depending free end. A plurality of small hole 174 are bored radially through the tube 170 at spacings along its length, and a small hole 176 is formed in the cap 172 at a slightly downward angle in the radially outward direction. An electric motor 178 is mounted on the top of the plate 152 with the motor drive shaft 180 extending downwardly through an opening 182 in the plate 152. A gear 184 is affixed to the end of the motor drive shaft 180 and meshes with another gear 186 affixed to the top end of the tube 170. The entire assembly of the plate 152, the solenoid and rotatable valves 156,158, the motor 178 and the gears 184,186 are enclosed within mating housing shells 188. Conventional electrical circuitry (not shown) provides electrical connection between a source of electricity and the solenoid valve 156 and the electric motor 178. The electrical circuitry includes a conventional timing switch device (also not shown) operative to normally maintain closed the solenoid air valve 156 and the energization of the electric motor 178 for a predetermined length of time upon each such actuation sufficient for rotation of the tube 170 at least one complete revolution, preferably two or more.

During each such actuation of the lint removal arrangement 150, compressed air is emitted radially outwardly through the holes 174 in the tube 170 and through the hole 176 in the cap 172 and is directed about the full circumference and for the full height of the creel 10 to blow off the creel 10 any lint accumulating thereon and to blow away from the creel 10 any airborne lint. The slight downward incline of the hole 176 in the cap 172 on the lower depending end of the tube 170 directs compressed air emitted therethrough toward the floor on which the creel 10 is supported and is thereby effective in keeping the floor virtually free of lint. The automatic operation of the lint removal arrangement 150 virtually eliminates the conventional necessity of having the knitting machine attendant periodically remove lint from the creel with a hand-held compressed air nozzle. The attendant is therefore freed to handle greater responsibilities in attending to the operation of the knitting machine and in replenishing yarn packages on the creel 10. Furthermore, the lint removal arrangement 150 is sufficiently effective to virtually eliminate the conventional need for special cleaning personnel to sweep the floor space below the creel. In a conventional knitting room operation, it would normally be necessary to sweep the floor space immediately beneath the creel approximately once a day. However, a creel 10 according to the present invention fitted with the described lint removal arrangement 150 has been operated for more than one month without any necessary sweeping. Accordingly, the lint removal arrangement 150 facilitates a significant reduction in overall labor costs in a conventional knitting room operation. Moreover, the use of compressed air effects a periodic addition of clean outside air to the knitting room environment and contributes to the enhancement of the cleanliness of the air.

As an alternative to the use of the lint removal arrangement 150, a motorized fan, indicated generally at 190 in FIG. 6, may be mounted directly above a creel according to the present invention for moving ambient air downwardly over and across the creel to aid in preventing lint accumulation. Preferably, the fan 190 is of the conventional ceiling-type fan. In the embodiment of FIG. 6, the fan 190 is mounted at the upper end of the central vertical support tube 95 of the creel framework. Alternatively, the fan 190 may be mounted on the creel 10 of FIG. 1 by use of an appropriate superstructure (not shown) adapted to be affixed to the upper circular frame member 20.

According to another feature of the present invention, small swatches of Velcro brand or a similar type adherent fabric or device are affixed to the yarn package supporting members 14,52,54,116 at each package supporting pin thereof for holding the free end of replacement packages when supported thereon. As seen in FIG. 3, Velcro swatches 192 are affixed on the slotted side of each yarn package supporting member 14 immediately below each pin 38. Velcro swatches 192 are affixed to the rearward side of each pivoted support arm 60,76 of the yarn package supporting members 52,54 of FIGS. 4 and 5, respectively. Similarly, Velcro swatches 192 are affixed to the yarn package supporting member 116 of FIG. 6 on the outward side surface of each square tube 118 immediately below the pins 122.

In the conventional winding of conical yarn packages, yarn is first applied at the larger base end of the conical support member with a length of the yarn at the first-applied end thereof being left to extend outwardly from the package as a yarn tail. As will thus be understood, when any such package is in use, the yarn tail will be the trailing end of the length of yarn wound on the package. It is this yarn tail of each package that is tied to an associated replacement package in the above-described operation of conventional creels so that the yarn feeding operation of the creel can proceed uninterrupted as yarn packages are replaced. However, before the yarn tail of a package is tied with its replacement package, the tail is left unattended to dangle while the package is in use or while the package is resting unused on the creel for subsequent replacement use. Sometimes, the yarn tails may become entangled causing problems in locating them and in properly tying the package to a replacement package and, in any event, it is often bothersome and time consuming for the attendant to be required to locate each yarn tail in order to tie it to its replacement package. The Velcro swatches 192 permit the attendant when putting each replacement package on the creel to locate at that time the yarn tail and to apply it to the associated Velcro swatch 192 which then holds the yarn tail for ready location and tying to the next replacement package. Thus, the Velcro swatches 192 further eliminate problems and save time and labor expense in the operation of creels according to the present invention.

The present invention has been described in detail above for purposes of illustration only and is not intended to be limited by this description or otherwise to exclude any variation or equivalent arrangement that would be apparent from, or reasonably suggested by, the foregoing disclosure to the skill of the art.

I claim:

1. A textile yarn creel for compactly and adjustably supporting diverse pluralities of yarn packages for feeding yarn therefrom to a textile knitting machine or like textile apparatus, comprising circular frame means, a plurality of longitudinal yarn package supporting means adapted for removable mounting axially on said frame means for selective arrangement thereon of varying selected numbers of said yarn package supporting means and at various selected circumferential locations and spacings about said frame means, each said yarn package supporting means having a plurality of yarn package mounting elements thereon for facing radially inwardly of said frame means when said package support means is mounted thereon, a selected number of said yarn package supporting means being mounted on said frame means at selected locations and spacings circumferentially thereabout for supporting a selected number of yarn packages for feeding yarns therefrom, and yarn guiding means disposed axially centrally of said frame means for receiving said yarns withdrawn from said yarn packages on said yarn package supporting means in a direction radially inwardly of said frame means and for directing said yarns to said textile apparatus, whereby said creel is adapted for selective adjustment for supporting differing pluralities of yarn packages in a compact circular area defined by said circular frame means.

2. A textile yarn creel according to claim 1 and characterized further in that said frame means comprises a pair of circular frame members spaced apart in coaxial parallel relation, and said yarn package supporting means extend axially between the circumferences of said frame members.

3. A textile yarn creel according to claim 1 and characterized further in that each said yarn package supporting means includes two identical sets of plural package support pins spaced transversely of the length of said yarn package supporting means with said pins of said two sets being spaced correspondingly along said yarn package supporting means and extending outwardly therefrom to extend generally radially inwardly of said frame means when mounted thereon, said two sets of pins being adapted for respectively supporting a first set of yarn packages for yarn feeding use and a second set of yarn packages for replacement of said first set of yarn packages upon exhaustion thereof.

4. A textile yarn creel according to claim 3 and characterized further in that each said yarn package supporting means comprises a pair of longitudinal members for independent mounting on said frame means in side-by-side relation at selected circumferential spacings from one another, each said longitudinal member including one set of said package support pins.

5. A textile yarn creel according to claim 3 and characterized further in that each said yarn package supporting means comprises a longitudinal member having two sets of plural package support arms mounted respectively along opposite sides of said yarn package supporting means, each said package support arm having one said package support pin extending therefrom and each said package support arm being movable between an operative position wherein said package support pin is disposed at an outward spacing from its respective side of said longitudinal member for extending radially inwardly of said frame means when said longitudinal member is mounted thereon to orient a yarn package supported by said package support pin to extend toward said yarn guiding means for withdrawal of yarn from said yarn package and an inoperative position wherein said arm and said package support pin are spaced from said operative position sufficiently for withdrawal of a spent yarn package and insertion of another yarn package through the space occupied by said arm and said pin in said operative position.

6. A textile yarn creel according to claim 3 and characterized further by means for mounting said yarn package supporting means on said frame means for selective sliding movement circumferentially thereabout.

7. A textile yarn creel according to claim 6 and characterized further in that said mounting means comprises slot means connected with each said yarn package supporting means for receiving said circular frame means for sliding circumferential movement of said slot means and said yarn package supporting means about said frame means, and clamp means associated with each said slot means for receipt therein in braced engagement with said slot means and said frame means for holding said frame means and said slot means together.

8. A textile yarn creel according to claim 7 and characterized further in that said yarn package supporting means includes a longitudinal member for mounting on said frame means, said slot means including a slot formed transversely in said longitudinal member for receiving said circular frame means and said clamp means.

9. A textile yarn creel according to claim 6 and characterized further in that said mounting means includes means for mounting said yarn package supporting means on said frame means for selective movement radially thereof.

10. A textile yarn creel according to claim 9 and characterized further in that said mounting means includes bracket means having slot means for receipt of and affixation to said frame means for sliding circumferential movement of said bracket means thereabout, and having channel means for receiving said yarn package supporting means for movement in said channel means radially relative to said frame means.

11. A textile yarn creel according to claim 3 and characterized further in that said frame means includes a concentric inner circular element and said yarn guiding means includes a plurality of longitudinal yarn eyelet members corresponding in number to said yarn package supporting means adapted to be mounted axially on said inner circular element at selected circumferential locations and spacings thereabout, each said eyelet member having a set of yarn eyelets spaced therealong corresponding in number and spacing to one said set of said package support pins for facing generally radially outwardly of said inner circular element when mounted thereon, a selected number of said yarn eyelet members corresponding to said selected number of said yarn package supporting means being mounted on said inner frame element at selected circumferential locations and spacings thereabout to be respectively positioned intermediate the respective sets of package support pins of said selected number of said yarn package supporting means, whereby said eyelets of each said eyelet member are disposed to receive yarn in a substantially identical fashion from yarn packages on both sets of the respective associated one of said supporting means.

12. A textile yarn creel according to claim 11 and characterized further in that said yarn guiding means includes a plurality of yarn feeding tubes for selective connection respectively with said yarn eyelets of said selected number of said eyelet members for receiving said yarns from said eyelets thereof and directing said yarns to said textile apparatus.

13. A textile yarn creel according to claim 1 and characterized further by means for removing lint from said creel comprising a compressed air source, an air emission tube disposed substantially axially centrally of said frame means, said emission tube being connected with said source to receive compressed air therefrom and having plural emission ports at selected locations spaced therealong for emitting said compressed air at plural locations radially outwardly toward said frame means and said yarn guiding means for removing and preventing lint accumulation thereon.

14. A textile yarn creel according to claim 13 and characterized further in that said lint removing means comprises means for rotating said emission tube and timing means for periodically actuating said tube rotating means to rotate said emission tube at least one complete revolution and for periodically actuating said compressed air source simultaneously to direct said compressed air into said emission tube throughout said revolution of said emission tube, thereby for emitting said compressed air outwardly about the full circumference of said creel.

15. A textile yarn creel according to claim 1 and characterized further by rotary fan means mounted on said frame means at an end thereof to move ambient air across said frame means, supporting means and said yarn guiding means for removing and preventing lint accumulation thereon.

16. A textile yarn creel for compactly and adjustably supporting diverse pluralities of yarn packages for feeding yarn therefrom to a textile knitting machine or like textile apparatus, comprising a pair of circular frame members each having a outer circular element and a concentric inner circular element, said frame members being disposed in spaced apart coaxially parallel relationship, a plurality of longitudinal yarn package supporting means adapted to be mounted on said outer circular elements to extend axially therebetween for selective removal therefrom and for selective circumferential disposition and movement thereabout, each said yarn package supporting means having two identical sets of plural package support pins spaced transversely of the length of said yarn package supporting means with said pins of said two sets being correspondingly spaced along said yarn package supporting means and extending outwardly therefrom to extend generally radially inwardly of said outer frame elements when mounted thereon, a selected number of said yarn package supporting means being mounted on said outer frame members at selected circumferential spacings and locations for supporting a selected number of primary yarn packages on one set of said package support pins of each said yarn package supporting means for initially feeding yarns from said primary yarn packages and for supporting a corresponding number of replacement yarn packages on the other set of said package support pins of each said yarn package supporting means for subsequently feeding yarns from said replacement yarn packages upon exhaustion of said primary yarn packages, and a plurality of longitudinal yarn eyelet members corresponding in number to said plurality of yarn package supporting means adapted to be mounted on said inner circular elements to extend axially therebetween for selective removal therefrom and for selective circumferential movement thereabout, each said yarn eyelet member having a set of yarn eyelets spaced therealong corresponding in number and spacing to one said set of package support pins for facing generally radially outwardly of said inner circular elements when mounted thereon, a selected number of said yarn eyelet members corresponding to said selected number of said yarn package supporting means being mounted on said inner circular elements at selected circumferential locations and spacings to be respectively positioned circumferentially intermediate said two sets of said package support pins of said yarn package supporting means for receiving said yarns of said primary and replacement packages supported thereon along radially inward yarn traveling paths in substantially identical fashion from both said primary and replacement yarn packages for feeding of said yarns to said textile apparatus, whereby said creel is adjustably adapted for selectively supporting diverse pluralities of yarn packages for yarn feeding operation in a compact circular area defined by said circular frame members.

17. A textile yarn creel according to claim 16 and characterized further by means for removing lint from said creel comprising a compressed air source, an air emission tube disposed substantially axially centrally of said frame means, said emission tube being connected with said source to receive compressed air therefrom and having plural emission ports at selected locations spaced therealong for emitting said compressed air at plural locations radially outwardly toward said frame means, said yarn package supporting means and said yarn guiding means, means for rotating said emission tube, and timing means for periodically actuating said tube rotating means to rotate said emission tube at least one complete revolution and for periodically actuating said compressed air source simultaneously to direct said compressed air into said emission tube throughout said revolution of said emission tube, thereby for emitting said compressed air outwardly about the full circumference of said creel for removing and preventing lint accumulation thereon.

18. A textile yarn creel according to claim 16 and characterized further in that each said yarn package supporting means comprises a pair of longitudinal members for independent mounting on said outer circular elements in side-by-side relation at selected circumferential spacings from one another, each said longitudinal member including one set of said package support pins.

19. A textile yarn creel according to claim 18 and characterized further by slot means formed transversely in each end of each said longitudinal member for receiving said outer circular elements for permitting selective sliding movement circumferentially thereon of said longitudinal member and selectively actuable clamp means associated with each said longitudinal member for receipt in each said slot means thereof for braced engagement with said longitudinal member and said outer circular elements for holding said outer circular elements and said longitudinal member together.

20. A textile yarn creel according to claim 18 and characterized further by means for removing lint from said creel comprising a compressed air source, an air emission tube disposed substantially axially centrally of said frame means, said emission tube being connected with said source to receive compressed air therefrom and having plural emission ports at selected locations spaced therealong for emitting said compressed air at plural locations radially outwardly toward said frame means, said yarn package supporting means and said yarn guiding means, means for rotating said emission tube, and timing means for periodically actuating said tube rotating means to rotate said emission tube at least one complete revolution and for periodically actuating said compressed air source simultaneously to direct said compressed air into said emission tube throughout said revolution of said emission tube, thereby for emitting said compressed air outwardly about the full circumference of said creel for removing and preventing lint accumulation thereon.

21. A textile yarn creel according to claim 16 and characterized further in that each said yarn package supporting means comprises a longitudinal member having two sets of plural package support arms respectively along opposite sides of said yarn package supporting means, each said package support arm having one said package support pin extending therefrom and each said package support arm being pivotable between an operative position wherein said package support pin is disposed at an outward spacing from its respective side of said longitudinal member for extending radially inwardly of said outer circular elements when said longitudinal member is mounted thereon to orient a yarn package supported by said package support pin to extend toward said yarn eyelet members for radial inward withdrawal of yarn from said yarn package and an inoperative position wherein said arm and said package support pin are spaced from said operative position sufficiently for withdrawal of a spent yarn package and insertion of another yarn package through the space occupied by said arm and said pin in said operative position.

22. A textile yarn creel according to claim 21 and characterized further by slot means formed transversely in each end of each said longitudinal member for receiving said outer circular elements for permitting selective sliding movement circumferentially thereon of said longitudinal member and selectively actuable clamp means associated with each said longitudinal member for receipt in each said slot means thereof for braced engagement with said longitudinal member and said outer circular elements for holding said outer circular elements and said longitudinal member together.

23. A textile yarn creel according to claim 22 and characterized further by means for removing lint from said creel comprising a compressed air source, an air emission tube disposed substantially axially centrally of said frame means, said emission tube being connected with said source to receive compressed air therefrom and having plural emission ports at selected locations spaced therealong for emitting said compressed air at plural locations radially outwardly toward said frame means, said yarn package supporting means and said yarn guiding means, means for rotating said emission tube, and timing means for periodically actuating said tube rotating means to rotate said emission tube at least one complete revolution and for periodically actuating said compressed air source simultaneously to direct said compressed air into said emission tube throughout said revolution of said emission tube, thereby for emitting said compressed air outwardly about the full circumference of said creel for removing and preventing lint accumulation thereon.

24. A textile yarn creel according to claim 16 and characterized further by bracket means having slot means for receipt of and affixation to said frame means for sliding circumferential movement of said bracket means thereabout and channel means oriented substantially perpendicularly to said slot means for receiving said yarn package supporting means for movement in said channel means radially relative to said frame means.

25. A textile yarn creel for compactly supporting a plurality of yarn packages for feeding yarn therefrom to a textile knitting machine or like textile apparatus, comprising a plurality of longitudinal yarn package supporting means each having plural yarn package mounting elements spaced therealong for supporting a plurality of yarn packages for off-winding of yarns therefrom, said yarn package supporting means being circularly arranged in axially parallel relation with said package mounting elements extending generally radially inwardly, yarn guiding means disposed axially centrally of said yarn package supporting means for receiving said yarns from said yarn packages and directing said yarns to said textile apparatus, and lint removal means including a compressed air source, an air emission tube disposed substantially axially centrally of said frame means, said emission tube being connected with said source to receive compressed air therefrom and having plural emission ports at selected locations spaced therealong for emitting said compressed air at plural locations radially outwardly toward said frame means, said yarn package supporting means and said yarn guiding means, means for rotating said emission tube, and timing means for periodically actuating said tube rotating means to rotate said emission tube at least one complete revolution and for periodically actuating said compressed air source simultaneously to direct said compressed air into said emission tube throughout said revolution of said emission tube, thereby for emitting said compressed air outwardly about the full circumference of said creel for removing and preventing lint accumulation thereon.

26. A textile yarn creel according to claim 1 and characterized further by means located axially centrally of siad frame means for creating a moving airstream radially outwardly toward said frame means and said yarn guiding means for removing and preventing lint accumulation thereon.

27. A textile yarn creel according to claim 16 and characterized further by means located axially centrally of said frame means for creating a moving airstream radially outwardly toward said frame means and said yarn guiding means for removing and preventing lint accumulation thereon.

28. A textile yarn creel according to claim 13 and characterized further in that said creel is adapted to be supported in axially upstanding disposition on a floor surface, one said emission port being located at the lowermost end of said tube adjacent the floor surface and oriented at a downward angle for emitting said compressed air toward said floor surface for removing and preventing lint accumulation thereon.

29. A textile yarn creel according to claim 17 and characterized further in that said creel is adapted to be supported in axially upstanding disposition on a floor surface, one said emission port being located at the lowermost end of said tube adjacent the floor surface and oriented at a downward angle for emitting said compressed air toward said floor surface for removing and preventing lint accumulation thereon.

30. A textile yarn creel according to claim 25 and characterized further in that said creel is adapted to be supported in axially upstanding disposition on a floor surface, one said emission port being located at the lowermost end of said tube adjacent the floor surface and oriented at a downward angle for emitting said compressed air toward said floor surface for removing and preventing lint accumulation thereon.

31. A textile yarn creel according to claim 1 and characterized further by yarn attachment means on each said yarn package supporting means in association with each yarn package mounting element for holding respective free yarn ends of said yarn packages for ready access thereto.

32. A textile yarn creel according to claim 16 and characterized further by yarn attachment means on each said yarn package supporting means in association with each said set of said pins for selectively holding the free yarn ends of said primary and replacement yarn packages for ready access thereto.

33. A textile yarn creel according to claim 32 and characterized further in that said yarn attachment means comprises a swatch of yarn adherent fabric affixed to each said yarn package supporting means at each said set of pins.

34. A textile yarn creel according to claim 5 and characterized further in that each said yarn package supporting means includes means pivotably supporting each said package support arm for pivotal movement in a generally radial direction between its operative and inoperative positions in a direction generally radially of said frame means for positioning each respective said pin outwardly of said frame means in said operative position for ready replacement of the yarn package thereon.

35. A textile yarn creel according to claim 21 and characterized further in that each said yarn package supporting means includes means pivotably supporting each said package support arm for pivotal movement in a generally radial direction between its operative and inoperative positions in a direction generally radially of said frame means for positioning each respective said pin outwardly of said frame means in said inoperative position for ready replacement of the yarn package thereon.

* * * * *

UNITED STATES PATENT OFFICE

CERTIFICATE OF CORRECTION

Patent No. 4,540,138 Dated September 10, 1985

Inventor(s) Alan Gutschmit

It is certified that error appears in the above-identified patent and that said Letters Patent are hereby corrected as shown below:

Column 2, Line 1, delete "works" and insert therefor -- workers -- .
Column 5, Line 11, delete "nay" and insert therefor -- any -- .
Column 5, Line 22, delete "weld" and insert therefor -- welded -- .
Column 6, Line 2, delete "26" and insert therefor -- 28 -- .
Column 6, Line 45, after "45" omit -- to -- .
Column 6, Line 45, delete "30" and insert therefor -- 20 -- .
Column 6, Line 56, delete "46" and insert therefor -- 16 -- .
Column 7, Line 63, delete "comprising" and insert therefor -- compromising -- .
Column 10, Line 30, delete "facilities" and insert therefor -- facilitates -- .
Column 10, Line 65, delete "or" and insert therefor -- of -- .
Column 11, Line 60, delete "formd" and insert therefor -- formed -- .
Column 21, Line 1, delete "siad" and insert therefor -- said -- .
Column 22, Line 23, delete "operative" and insert therefor -- inoperative -- .

Signed and Sealed this

*Twenty-fifth* Day of *March 1986*

[SEAL]

*Attest:*

DONALD J. QUIGG

*Attesting Officer* *Commissioner of Patents and Trademarks*